US010428502B2

(12) United States Patent
Parker

(10) Patent No.: US 10,428,502 B2
(45) Date of Patent: Oct. 1, 2019

(54) FLUSH MECHANISM FOR TOILETS

(71) Applicant: Peter M. Parker, Baraboo, WI (US)

(72) Inventor: Peter M. Parker, Baraboo, WI (US)

(73) Assignee: Peter M. Parker, Baraboo, WI (US)

( * ) Notice: Subject to any disclaimer, the term of this patent is extended or adjusted under 35 U.S.C. 154(b) by 0 days.

(21) Appl. No.: 15/715,420

(22) Filed: Sep. 26, 2017

(65) Prior Publication Data

US 2019/0093326 A1 Mar. 28, 2019

(51) Int. Cl.
*E03D 1/33* (2006.01)
*E03D 5/094* (2006.01)

(52) U.S. Cl.
CPC ..... *E03D 1/33* (2013.01); *E03D 5/094* (2013.01)

(58) Field of Classification Search
CPC ..... E03D 1/14–144; E03D 1/306; E03D 1/33–35
USPC ..... 4/378, 388–391, 396, 402–403
See application file for complete search history.

(56) References Cited

U.S. PATENT DOCUMENTS 3,280,407 A * 10/1966 Maurice ..... E03D 1/304 4/372
3,461,461 A 8/1969 Anthony
3,461,465 A * 8/1969 Fisher ..... E03D 1/025 4/353
5,197,151 A * 3/1993 Jasper, Jr. ..... E03D 1/142 4/378
5,548,849 A * 8/1996 Sulit ..... E03D 1/142 4/324
6,381,764 B2 * 5/2002 Stahlhut ..... E03D 1/142 4/390
6,397,404 B1 6/2002 Ferreyra et al.
6,584,622 B1 * 7/2003 Nilsson ..... E03D 1/142 4/324
6,925,658 B2 * 8/2005 Parker ..... E03D 1/34 4/391
7,185,374 B2 * 3/2007 Rodriguez ..... E03D 1/34 4/378
7,634,821 B2 * 12/2009 Denzin ..... E03D 1/33 4/378
2007/0101485 A1 * 5/2007 Denzin ..... E03D 1/33 4/378
2008/0209621 A1 * 9/2008 Tilson ..... E03D 1/142 4/378

* cited by examiner

*Primary Examiner* — Erin Deery
*Assistant Examiner* — Nicholas A Ros

(57) ABSTRACT

A flush mechanism for a toilet with a tank can include a float basket with a drainage port and at least one peripheral wall. A flexible conduit can be secured to the float basket to provide a liquid flow path from the drainage port to a flush port of the tank. The drainage port can be disposed eccentrically within the float basket, a top profile of the at least one peripheral wall can be inclined, or a rotatable collar can be provided to control flow of water into the drainage port.

20 Claims, 8 Drawing Sheets

FLUSH MECHANISM FOR TOILETS

CROSS-REFERENCE TO RELATED APPLICATION(S)

Not applicable

STATEMENT OF FEDERALLY SPONSORED RESEARCH OR DEVELOPMENT

Not applicable.

FIELD OF THE DISCLOSURE

This disclosure relates to toilets, including toilets operated by gravity-driven water flows from elevated tanks.

BACKGROUND OF THE DISCLOSURE

Conventional toilets include a toilet tank with an internal flush port (e.g., flanged tank opening) at the bottom thereof. A flapper resting on top of the flush port generally forms a seal to stop the flow of water through the flush valve. When a toilet handle outside the tank is manually activated, the flapper is generally lifted, thereby allowing water to flow through the flush port and into a toilet bowl to flush the toilet. However, degradation in the flapper and/or the flush port can result in degeneration of the seal between the two components, resulting in undesired leakage of water from the tank.

SUMMARY OF THE DISCLOSURE

Embodiments of the invention can include a flush mechanism for a toilet, which may be useful in reducing leakage from a toilet tank.

According to one embodiment of the invention, a flush mechanism for a toilet with a tank can include a float basket that is configured to float on water within the tank, and that includes at least one inclined peripheral wall that at least partly defines an interior reservoir of the float basket, and a drainage port configured to drain the interior reservoir. A flexible conduit can be secured to the float basket to provide a liquid flow path between the drainage port and the flush port, such that water flooding from the tank into the interior reservoir and through the drainage port flows along the liquid flow path to exit the tank.

According to one embodiment of the invention, a flush mechanism for a toilet with a tank can include a float basket that is configured to float on water within the tank, and that includes at least one peripheral wall that at least partly defines an interior reservoir of the float basket, and a drainage port that is configured to drain the interior reservoir and is eccentrically disposed within the float basket. A flexible conduit can be secured to the float basket to provide a liquid flow path between the drainage port and the flush port, such that water flooding from the tank into the interior reservoir and through the drainage port flows along the liquid flow path to exit the tank.

According to one embodiment of the invention a flush mechanism for a toilet with a tank can include a float basket that is configured to float on water within the tank, and that includes at least one peripheral wall that at least partly defines an interior reservoir of the float basket, and a drainage port configured to drain the interior reservoir. A flexible conduit can be secured to the float basket to provide a liquid flow path between the drainage port and the flush port, such that water flooding from the tank into the interior reservoir and through the drainage port flows along the liquid flow path to exit the tank. A collar can include one or more collar openings. The collar can be configured to be secured around the rim, and to rotate relative to the rim, to control alignment of the one or more collar openings with the one or more rim openings to control a flow rate of water through the drainage port.

The details of some embodiments of the invention are set forth in the accompanying drawings and the description below, along with certain features and advantages. Other embodiments, and other features and advantages, will be apparent from the description, the drawings, and the claims.

DETAILED DESCRIPTION

Figure 1:
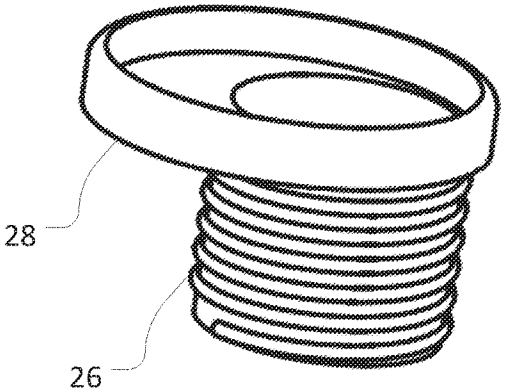
FIG. 1 is an isometric view of an outlet fitting for a flush mechanism according to an embodiment of the invention.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Likewise, the phrases "at least one of A, B, and C," "one or more of A, B, and C," and the like, are meant to indicate A, or B, or C, or any combination of A, B, and/or C.

Unless specified or limited otherwise, the terms "mounted," "connected," "supported," "coupled," and the like thereof are used broadly and encompass both direct and indirect mountings, connections, supports, and couplings. Further, "connected" and "coupled" are not restricted to physical or mechanical connections or couplings.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the any use of terms "comprises" and/or "comprising" in this specification specifies the presence of stated features, integers, steps, operations, elements, and/or components, but do not preclude the presence or addition of one or more other features, integers, steps, operations, elements, components, and/or groups thereof.

As used herein, unless otherwise defined or limited, "flexible" indicates a feature that is configured to be bendable, compressible, bendable and compressible, or otherwise deformable.

As noted above, conventional flush mechanisms for toilets can include flush valves that are sealed by flappers, which can be prone to leakage. Embodiments of the invention can address this issue, and others. For example, some embodiments of the invention can provide a flush mechanism that relies on controlled flooding of a float basket to release water from a toilet tank into a toilet bowl. In some cases, this can eliminate the need for a flapper and the corresponding likelihood of undesired leakage.

Generally, a flush mechanism according to some embodiments of the invention can include a float basket configured to float at the surface of water within a toilet tank. The float basket can include a drainage port, which can extend through the float basket to the interior of a flexible conduit. The flexible conduit can be secured to a seal assembly, which in turn can be secured to a flush port (e.g., a flanged opening) on the toilet tank. Thus arranged, a fluid-tight flow path can be defined from the drainage port of the float basket, through the flexible conduit to the flush port, and out of the toilet tank. Accordingly, when the float basket floats on the surface of water within the toilet tank, the flow path can be isolated from the water in the toilet tank, such that no water flows from the toilet tank through the flush port and the toilet does not flush. In contrast, when the float basket is partially (or fully) submerged, as may be effected by actuation of an exterior toilet handle, water can be allowed to flow into (i.e., flood) the float basket, then flow through the drainage port into the flexible conduit and out of the flush port, thereby causing the toilet to flush.

In some embodiments, other features can be provided. For example, some embodiments can include a float basket that is eccentrically formed relative to the drainage port, with the float basket extending farther from the drainage port in one direction than in an opposite direction. This may be useful, for example, to allow for a sufficiently buoyant (e.g., sufficiently large) float basket, while avoiding interference with other mechanisms within the toilet tank (e.g., a float that controls refilling of the tank). As another example, some embodiments can include an anchor plate with multiple anchor points. A cable (i.e., generally, a flexible extended member configured to transmit pulling force, such as single-strand, braided, and non-braided lines) can be received at any one of the anchor points in order to allow for relatively easy conversion of the relevant flush mechanism between left-hand and right-hand flush configurations.

As another example, some embodiments can include a control device for flow of water through the drainage port of the float basket. For example, in some embodiments, a rim (e.g., an integral, raised wall) can surround a drainage port of a float basket, with the rim punctuated by one or more drainage openings. A collar with one or more corresponding collar openings can be configured to be rotatably seated around the rim, so that rotation of the collar relative to the rim can selectively align one or more of the collar openings with one or more of the drainage openings. In this way, for example, the collar can be rotated relative to the rim in order to generally control the flow rate of water from the float basket into the drainage port for flushing of the relevant toilet.

As another example, some embodiments can include a float basket with one or more inclined peripheral walls. For example, opposite elongate walls of an elongate float basket can be angled obliquely relative to a central axis of a drainage port of the flush basket or a base wall (e.g., floor or bottom "hull") of the float basket. This can be useful, for example, in order to generally allow for easier control over inundation of the float basket, as well as to generally increase the amount of water from a particular tank that can move past the peripheral walls of the float basket to pass through the drainage port. It will be noted, relative to discussion herein, that a particular "peripheral" wall, including an inclined peripheral wall, may not necessarily surround an entire perimeter of a particular area (e.g., of an interior reservoir of a float basket).

Figure 7:
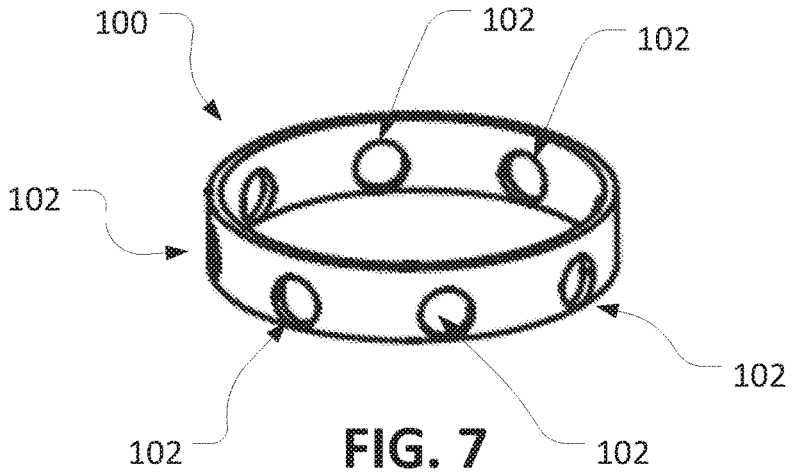
FIG. 7 is an isometric view of a control ring for use with the float basket of FIGS. 5 and 6.
Figure 8:
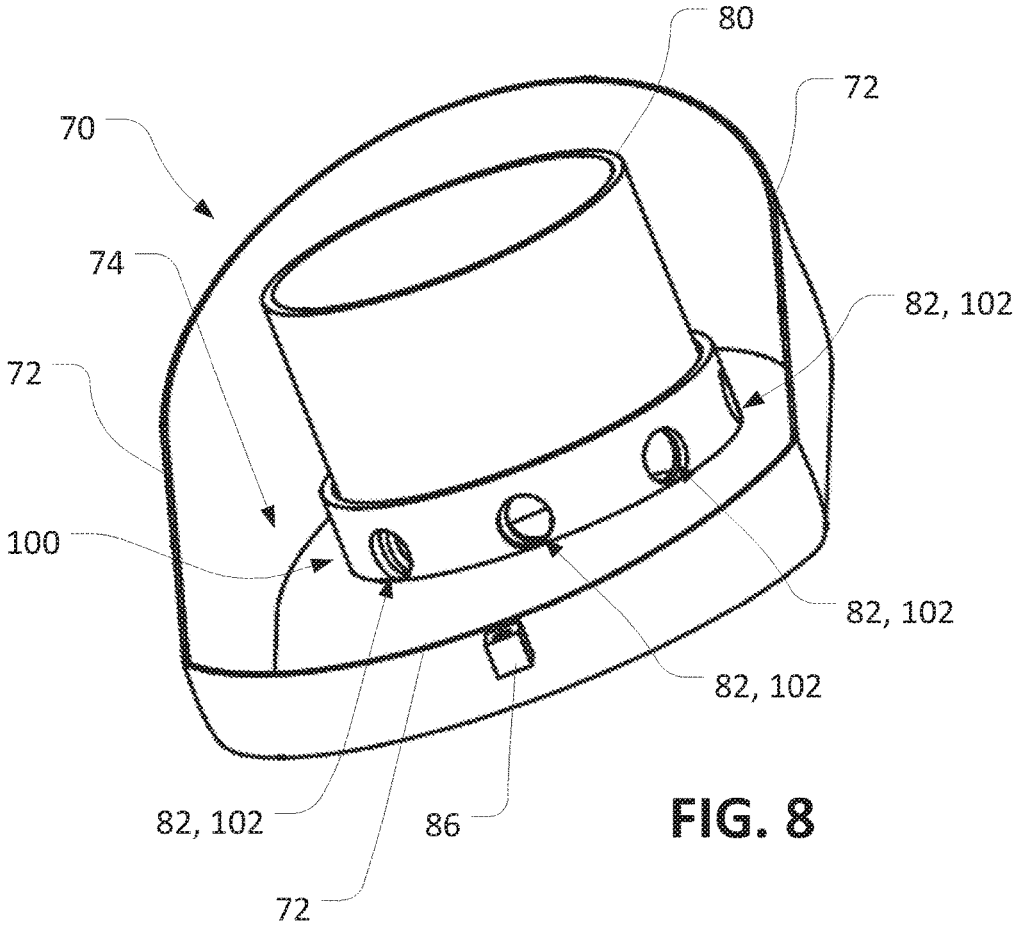
FIG. 8 is an isometric view of a float basket assembly according to an embodiment of the invention, including the control ring of FIG. 7 and the float basket of FIGS. 5 and 6.
Figure 9A:
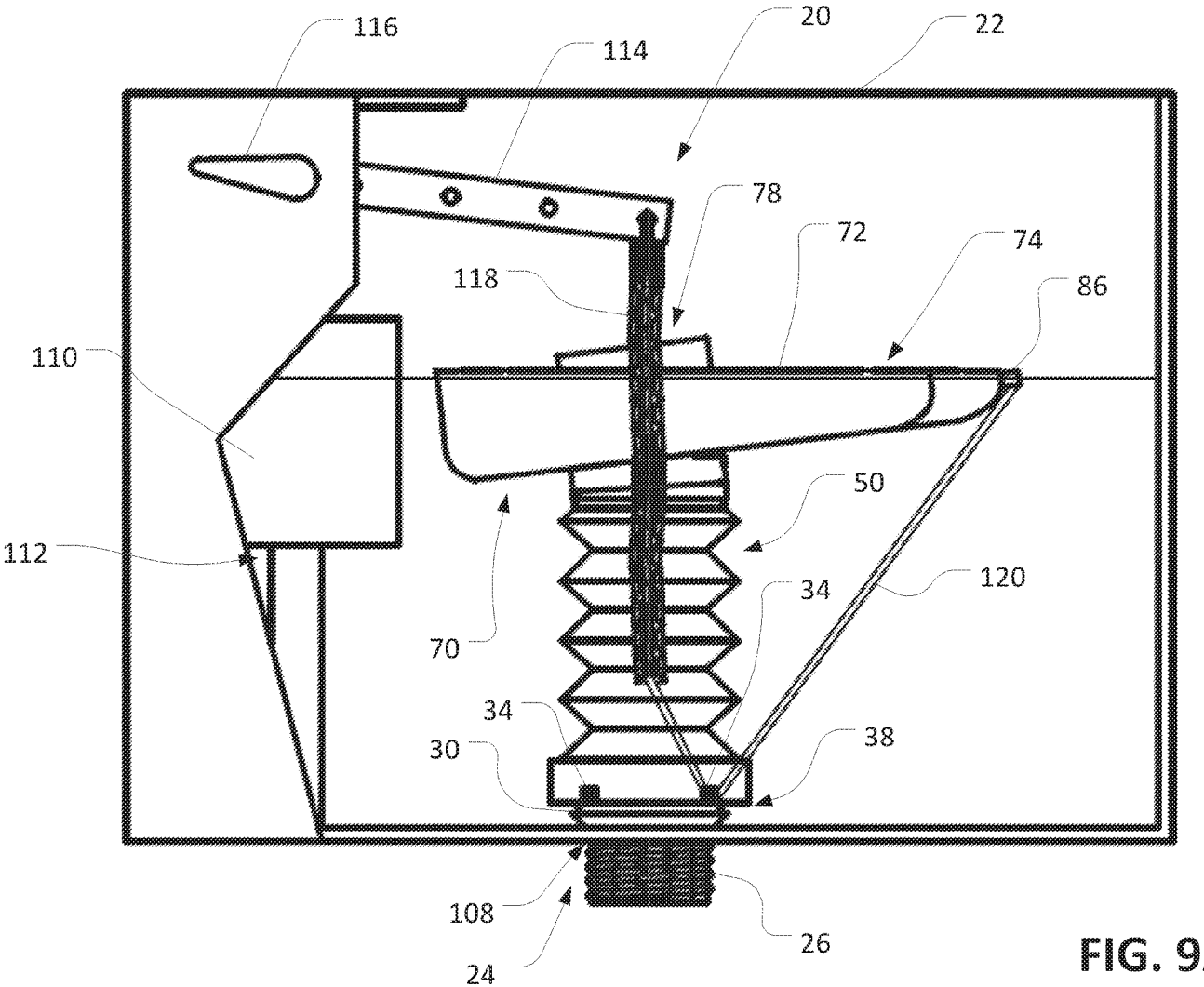
FIGS. 9A through 9C are side elevation views of a flush mechanism according to an embodiment of the invention, as installed in a toilet tank, at different stages of operation.
Figure 9B:
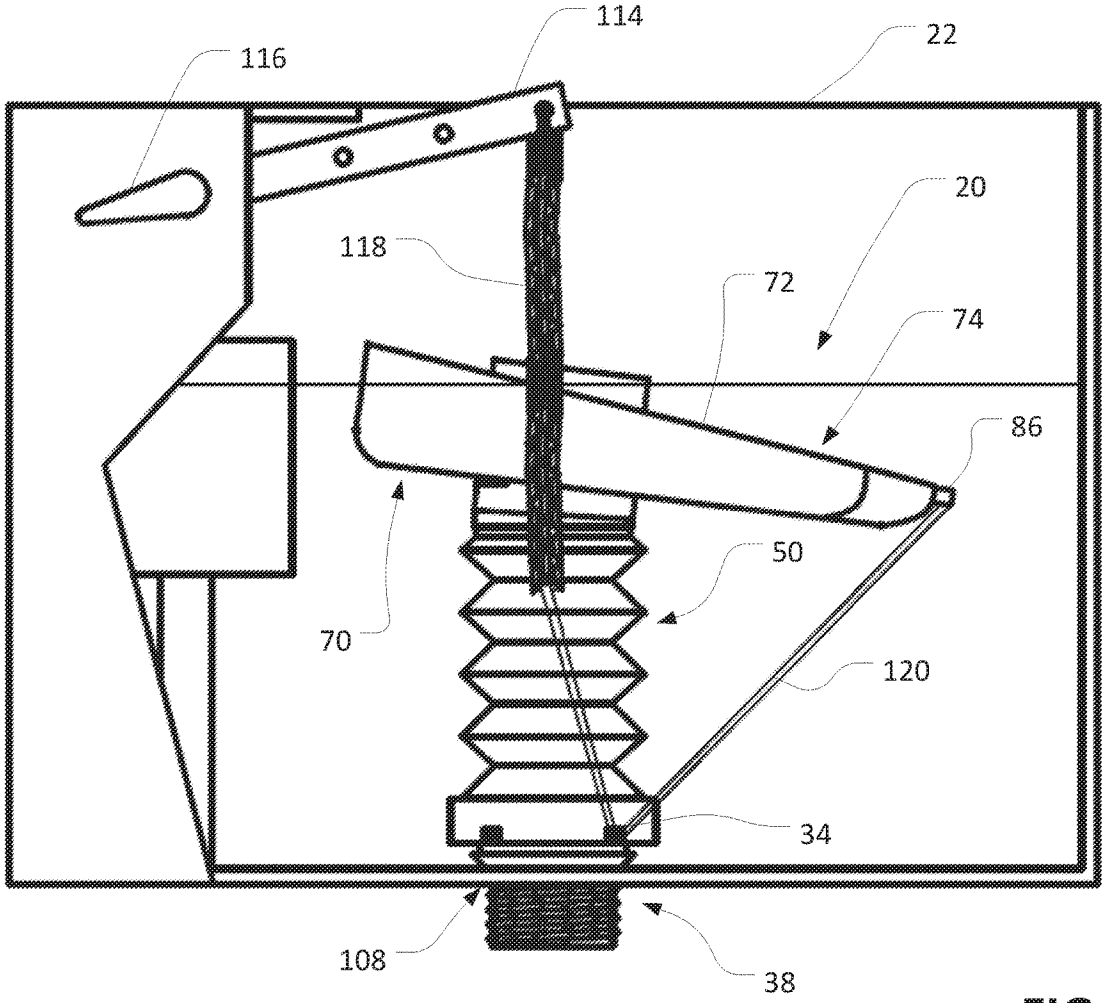
Figure 9C:
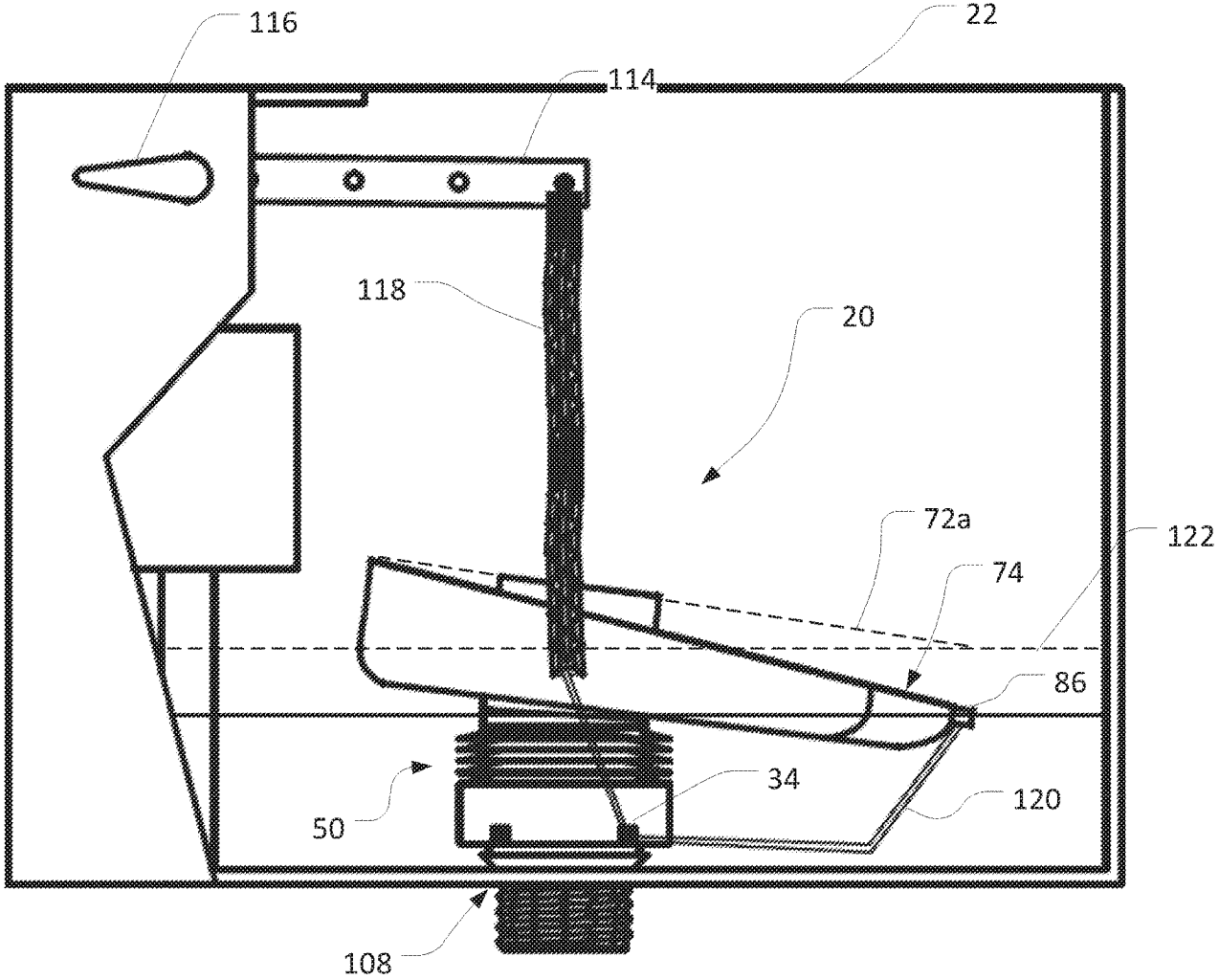

FIGS. 1 through 8 illustrate certain components of a flush mechanism 20, which is illustrated as installed in a toilet tank 22 in FIGS. 9A through 9C. The configuration of these components for, and their inclusion in, the flush mechanism 20 is presented as an example only. In other embodiments, other components and other configurations are possible.

FIG. 1 illustrates an outlet fitting 24 for use with the flush mechanism 20. Generally, an outlet fitting for a flush mechanism according to the invention is configured to be secured to a toilet tank at a flush port for the tank, in order to provide a terminus, at the flush port, for a flow path of the flush mechanism. To this end, for example, the outlet fitting 24 includes an extension 26 configured to extend through a flush port of a toilet tank (not shown), and a conduit seat 28 configured to be disposed inside of the tank. In the embodiment illustrated, the extension 26 is a threaded extension, which may assist in relatively easy attachment of the outlet fitting 24 to a relevant tank.

In different embodiments, different configurations are possible. As illustrated in FIG. 1, for example, the conduit seat 28 can generally exhibit a larger characteristic width (e.g., diameter) than the extension 26. This may be useful, for example, to provide an appropriate seat for a flexible tube (as discussed below) and to retain the conduit seat 28 within the relevant tank. In some embodiments, also as illustrated in FIG. 1, the conduit seat 28 can be eccentrically disposed relative to the extension 26. This may be useful, for example, to allow for an appropriately wide profile of the conduit seat 28, while also allowing the outlet fitting 24 to be appropriately installed in toilet tanks in which the flush port is eccentrically located or is otherwise subject to (or itself imposes) space restrictions.

Figure 3:
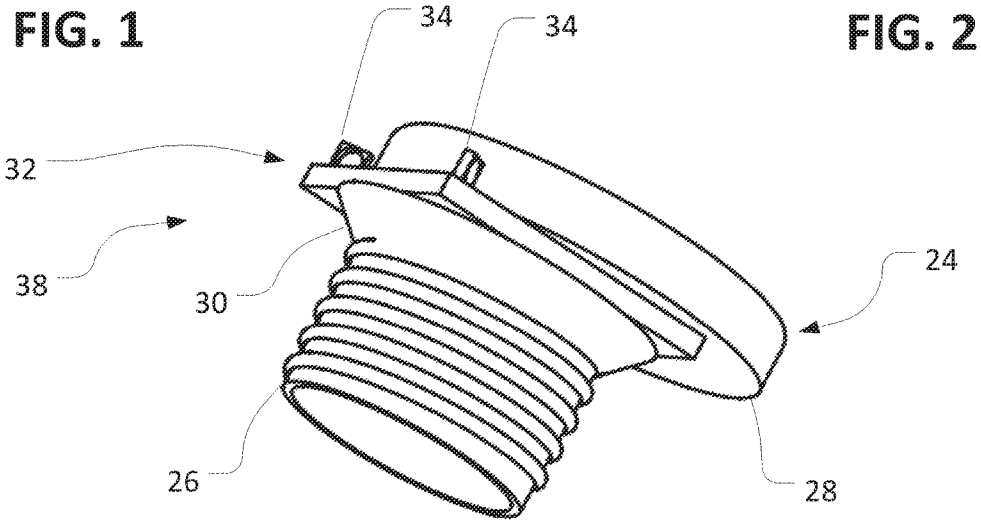
FIG. 3 is an isometric view of a seal assembly including the outlet fitting of FIG. 1 and the anchor plate of FIG. 2, according to an embodiment of the invention.

In some embodiments, an outlet fitting can be configured to provide a liquid-tight seal with a toilet tank at the flush port. As illustrated in FIG. 3, for example, a gasket, such as a tapered gasket 30, can be formed with or seated on the outlet fitting 24. As such, for example, using the threads on the extension 26 to secure the outlet fitting 24 at a flush port can compress the tapered gasket 30 at the flush port in order to prevent water from flowing out of the flush port, except through the interior of the extension 26.

Figure 2:
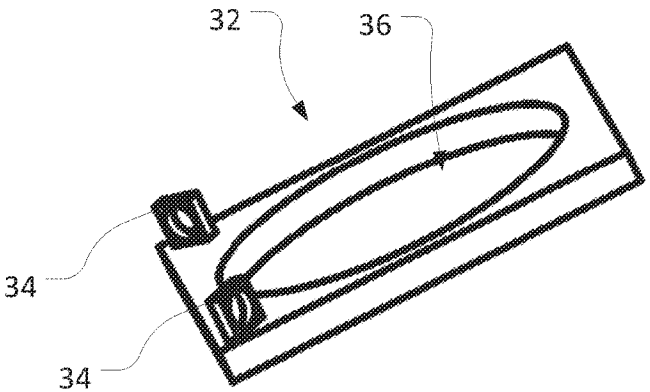
FIG. 2 is an isometric view of an anchor plate for a flush mechanism according to an embodiment of the invention.

In some embodiments, an anchor component can be provided in order to assist with activating the flush mechanism. As illustrated in FIG. 2, for example, an anchor component can be configured as an anchor plate 32 with one or more anchor points 34 and a central opening 36. In the embodiment illustrated, the anchor points 34 are configured as substantially similar eyelets disposed at different corners of the anchor plate 32. As also discussed below, this arrangement can allow for relatively easy conversion of a particular flush mechanism between left-hand and right-hand flush configurations. In other embodiments, other configurations are possible. For example, an anchor component can be configured as a non-plate component, or a different number or configuration of anchor points can be provided.

Generally, it may be useful to secure an anchor component to an outlet fitting, along with a separate seal (e.g., the gasket 30) as appropriate, to provide a seal assembly. As illustrated in FIG. 3, for example, a seal assembly 38 includes the outlet fitting 24, the gasket 30, and the anchor plate 32, with the extension 26 extending through the gasket 30 and the anchor plate 32, and the anchor plate 32 generally sandwiched between the gasket 30 and the conduit seat 28.

The configuration illustrated in FIG. 3 may exhibit a number of advantages, in addition to those noted above. For example, because the anchor plate 32 may be generally rotatable relative to the outlet fitting 24, at least until the threaded extension 26 is used to secure the assembly 38 in place. Accordingly, it may be possible to adjust the anchor plate 32 relatively easily to accommodate the particular geometries of a particular toilet. Further, due partly to the eccentric configuration of the conduit seat 28 relative to the extension 26, the anchor plate 32 can be formed with relatively small lateral dimensions, while still allowing the anchor points 34 of the two eyelets to extend clear of the conduit seat 28 for use (see, e.g., description of FIGS. 9A-9C).

Figure 4:
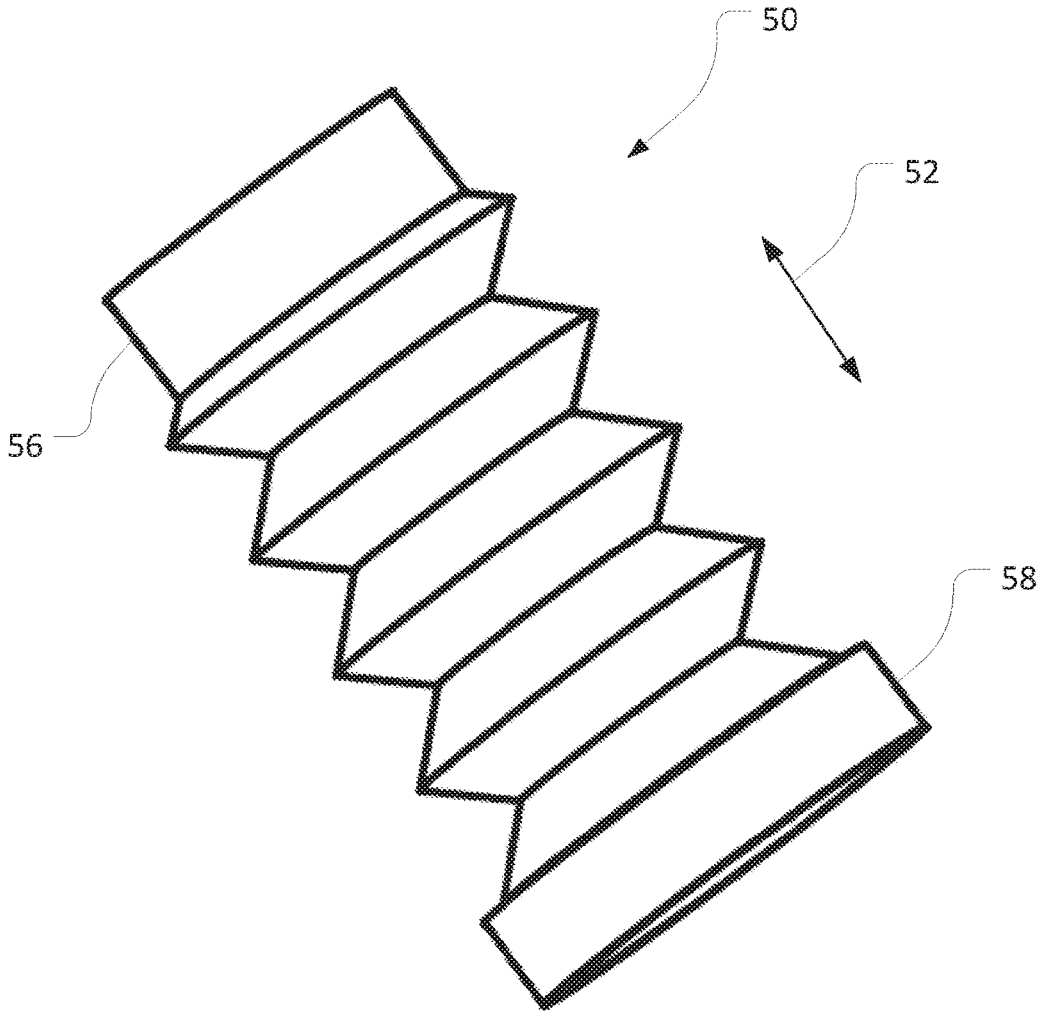
FIG. 4 is an isometric view of a flexible tube for a flush mechanism according to an embodiment of the invention.

FIG. 4 illustrates an example flexible conduit for use with the flush mechanism 20, configured as a corrugated bellows tube 50, which can be compressed and extended axially, as well as bent away from a strictly axial configuration in any number of directions. Generally, the tube 50 is configured to exhibit a compressed length (e.g., when fully compressed along a direction 52), and an extended length (e.g., when fully extended along the direction 52), and any variety of lengths therebetween. The tube 50 can generally be configured to exhibit any number of extended, resting, and compressed lengths, as may be appropriate for a particular application.

In the embodiment illustrated, the tube 50 is configured to exhibit a resting length that is generally equal to the compressed length (see FIG. 9C). This can be useful, for example, in order to allow the tube 50 to be relatively easily compressed when a toilet is flushed. In other embodiments, other configurations are possible.

Generally, a flexible tube for a flush mechanism according to the invention can be configured to be secured at one end to a seal assembly for a flush port, and at another end to a float basket, so as to define a flexible flow path between the flush port and the float basket. To this end, in the embodiment illustrated in FIG. 4, the tube 50 includes a somewhat narrow cylindrical portion 56 at an upper end, and a somewhat wider cylindrical portion 58 at a lower end. The cylindrical portion 56 is generally configured to nest within a corresponding extension of a float basket at a drainage port of the float basket (as also discussed below) in order to provide a fluid-tight seal. Likewise, the cylindrical portion 58 is generally configured to nest around the conduit seat 28 (see, e.g., FIG. 1), also in order to provide a fluid-tight seal. In some embodiments, adhesive or other joining techniques (e.g., ultrasonic welding) can be used to enhance one or more of these seals. In some embodiments, other attachment and sealing arrangements are possible.

Generally, as also described below, a float basket for a flush mechanism according to the invention can be configured to float at the surface of water within a toilet tank. When a user desires to flush the tank, the user can, for example, use a handle of the toilet to flood the float basket with water. This can allow water to move through the drainage port of the float basket, through the attached flexible conduit, and out of the flush port of the toilet tank. Because the float basket may be generally supported by buoyancy forces (particularly when not flooded), as the water level in the tank correspondingly decreases, the float basket generally also travels downwards, so that water can generally continue to flow through the float basket.

In some embodiments, it may be useful to configure a float basket in order to maximize the amount of water in a tank that can flow past (e.g., over) the peripheral walls of the float basket in order to exit the toilet tank via the drainage port. In some embodiments, for example, a float basket can be configured with generally inclined side walls, so that a part of the side walls presents a generally lower barrier to flooding of the float basket than the remainder of the side walls, without compromising the general ability of the float basket to float at the surface of water within the tank (e.g., to not be flooded) when the toilet is not being flushed.

Figure 5:
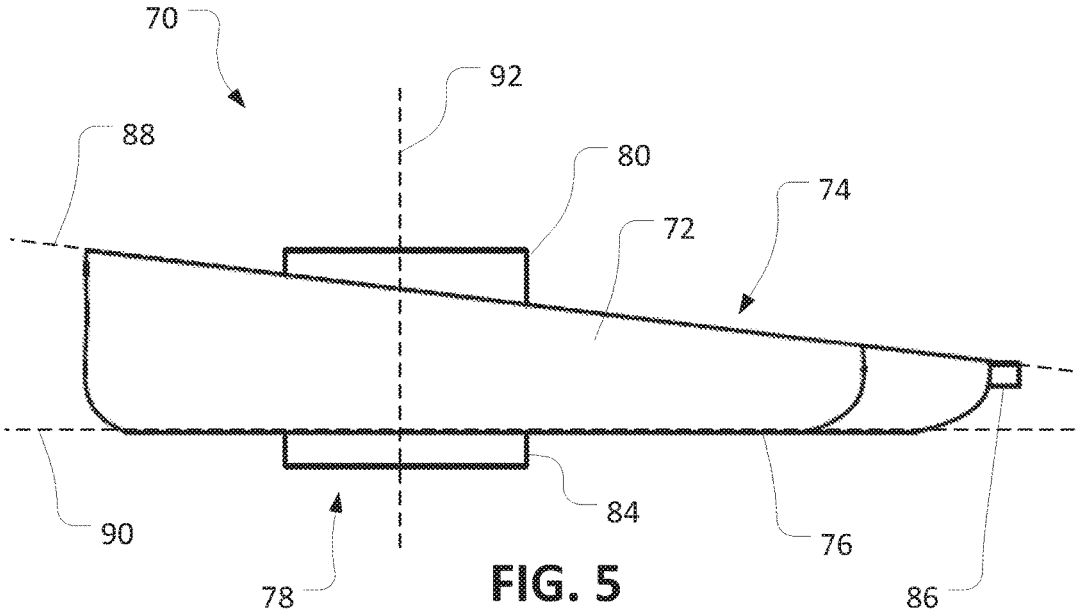
FIGS. 5 and 6 are side elevation and isometric views, respectively, of a float basket for a flush mechanism according to an embodiment of the invention.
Figure 6:
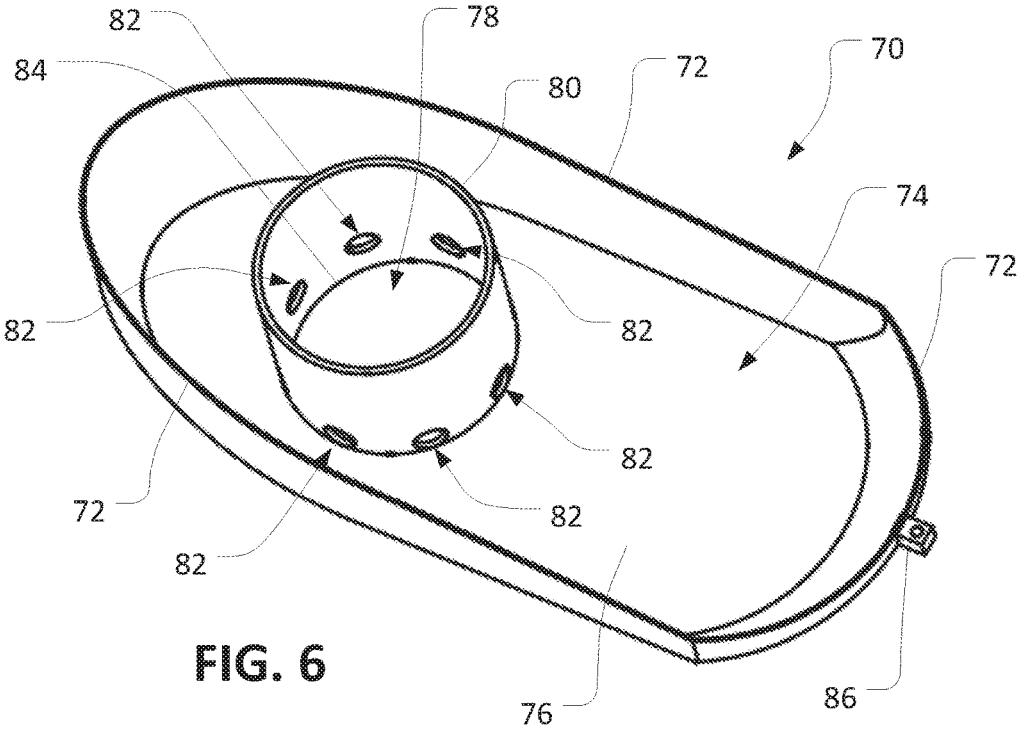

FIGS. 5 and 6 illustrate an example float basket 70 that may provide the benefits noted above, as well as various others. In the embodiment illustrated, for example, the float basket 70 is formed with a water barrier provided by a continuous peripheral wall 72, which generally surrounds an interior reservoir 74 and a base wall 76, and thereby enables the float basket 70 to float at the surface of water within a toilet tank.

Within the reservoir 74, a drainage port 78 extends through the base wall 76 at an eccentric location relative to the elongate dimension of the float basket 70 (i.e., left-to-right from the perspective FIG. 5). A rim around the drainage port is provided by an annular wall 80 that extends generally above most of the top edge of the peripheral wall 72, but generally not higher than the highest extent of the top edge of the peripheral wall 72 (e.g., at left in FIG. 5). The annular wall 80 generally includes a plurality of drainage openings 82 configured as regularly spaced circular openings that are generally adjacent to the base wall 76 and generally smaller in diameter than the drainage port 78. A further annular wall 84 extends generally below the base wall 76, and can provide an attachment feature for the cylindrical portion 56 of the flexible tube 50 (see, e.g., FIG. 4), as also discussed above.

Generally, the peripheral wall 72 is inclined, such that the one end of the peripheral wall 72 (i.e., to the left in FIG. 5) extends farther away from the base wall 76 than does another end of the peripheral wall 72 (i.e., to the right in FIG. 5). Correspondingly, in the embodiment illustrated, the interior reservoir 74 is somewhat deeper at one end (i.e., to the left in FIG. 5) than at another, opposite end (i.e., to the right in FIG. 5). As also discussed below, this can allow for a flush mechanism equipped with the float basket 70 to use more of the water within a particular toilet tank during a flushing operation. Further to this end, in order to help to flood the interior reservoir 74 from the shallower side (i.e., to the right in FIG. 5), an attachment feature, configured as an integral tab 86 is provided along the shorter-height portion of the peripheral wall 72.

In some embodiments, other types of attachment features can be provided, including at different locations. In some embodiments, no attachment feature may be provided. For example, a float basket can be configured to be flooded by using a relatively rigid body (e.g., a lever attached to a flush handle) to push an edge of a peripheral wall underwater.

In different embodiments, different types of inclines may be provided for different portions of one or more peripheral walls. In the embodiment illustrated, for example, the top of the peripheral wall 72 (i.e., as traced by a line 88 in FIG. 5) extends at an oblique angle relative to both the base wall 76 (i.e., as traced by a line 90 in FIG. 5) and a central axis 92 of the drainage port 78. Also in the embodiment illustrated, the top of the peripheral wall is generally linear between left and right sides (i.e., opposite elongate ends) of the float basket 70, from the side perspective provided by FIG. 5. In other embodiments, other angles and/or non-linear geometries are possible. Generally, however, it may be useful to provide sufficient height along the entirety of the peripheral wall 72 so that the float basket 70 will naturally float with the top of the peripheral wall 72 above the free surface of the relevant body of water.

In other embodiments, other configurations are possible. For example, different overall or partial geometries can be used for different features of a float basket, including a rim for a drainage port, an attachment feature for a flexible conduit, a peripheral wall (or walls), one or more drainage ports or drainage openings, and so on. In some cases, multiple distinct peripheral walls may be provided, such as a set of relatively straight peripheral walls joined as corners to provide a continuous enclosure for the interior reservoir. In some cases, a float basket can be integrally formed as a unitary component. In some cases, a float basket can be formed by multiple separate components that are joined together (e.g., using adhesives, ultrasonic welding, or other techniques).

Generally, as water floods into the interior reservoir 74, further flow into the drainage port 78, and thereby out of the toilet tank (as also described above) can be regulated by the configuration (e.g., size, shape, and number) of the drainage openings 82 in the rim provided by the annular wall 80. Accordingly, it may be useful to configure the openings 82 in order to appropriately regulate the rate of flow out of the tank (i.e., via the openings 82 and the drainage port 78) in view of the flow of water into the tank from known refilling mechanisms (e.g., automatic refilling devices that begin to refill a toilet tank even as the toilet is being flushed).

In some embodiments, the drainage openings 82 (or other aspects of the float basket 70, such as the diameter of the drainage port 78) can be configured to naturally provide an appropriate outflow from type of flow regulation. However, due to the variation of refill characteristics between different toilets and different plumbing systems (e.g., due to variations in water pressure), it may also be useful to provide an adjustment mechanism, in order to allow users to selectively control the relevant flow rate(s). In this regard, for example, it may be useful to provide a collar with control openings, such as a collar 100 with openings 102, as illustrated in FIG. 7.

Generally, the collar 100 can be configured to be seated (e.g., relatively loosely press-fit) around a drainage rim of a particular float basket, in order to allow for selective regulation of the flow rate through drainage openings in that rim. As illustrated in FIG. 8, for example, the collar 100 can be rotatably mounted around the annular wall 80 of the float basket 70, so that the openings 102 on the collar 100 are generally disposed at the same height above the base wall 76 as are the drainage openings 82 in the annular wall 80. The collar 100 can then be selectively rotated, in order to change the degree of actual alignment of the openings 102 with the openings 82 and thereby selectively restrict (or open) the flow area provided from the interior reservoir 74 to the drainage port 78 (see FIG. 6). In this way, for example, maximum flow rates can be provided with the openings 82, 102 fully aligned (as shown in FIG. 8), and minimal flow rates can be provided with the openings 82, 102 almost entirely (or entirely) mis-aligned, as may be appropriate for the particular refill characteristics of a particular toilet installed in a particular location.

In other embodiments, other configurations are possible. For example, in some embodiments, a set of differently sized openings can be provided in the collar 100. With such a configuration, for example, different flow rates through the drainage port 78 could be obtained by aligning differently sized sets of openings in the collar 100 with the drainage openings 82 in the wall 80. In some embodiments, other adjustment mechanisms that similarly control alignment of drainage openings can alternatively (or additionally) be used.

An example installation of the flush mechanism 20, including the seal assembly 38, the flexible bellows tube 50, and the float basket 70, is illustrated in FIGS. 9A-9C. Generally, the flush mechanism 20 can be installed so that the only flow path for water from the tank 22 out of a flush port 108 of the tank 22 extends from the float basket 70 through the tube 50. Accordingly, for example, the seal assembly 38 can be secured at the base of the tank 22 by threading a sealing nut (not shown) onto the threaded extension 26 of the outlet fitting 24, in order to compress the gasket 30 and thereby seal the tank 22 against leakage. Further, the tube 50 can be secured to the seal assembly 38 at a lower end, and to the float basket 70 at an upper end, so as to provide an enclosed flow path from the drainage port 78 of the float basket 70, through the tube 50, and out of the tank 22 at the flush port 108 via the extension 26. From the extension 26, the water can then flow to a bowl of the toilet (not shown) along various known flow paths.

The float basket 70, as secured to the flexible tube 50, is configured to float in the water within the tank 22, with the inclined top of the peripheral wall 72 entirely above the surface of the water. Accordingly, so long as the float basket 70 floats as illustrated in FIG. 9A, water may be generally prevented from flowing into the float basket 70 and, thereby, out of the tank 22. Also as illustrated in FIG. 9A, the eccentric configuration of the float basket 70 (as also discussed above) allows for the float basket 70 to float within the tank 22 without interference from (or with) a float 110 on a fill valve 112 of the toilet or other internal components (not shown).

In order to allow the toilet to be flushed, an internal lever 114 connected to an external flush handle 116 is generally connected to the float basket 70. In this way, for example, when the handle 116 is activated, the float basket 70 can be tipped into the water within the tank 22, so that the interior reservoir 74 is flooded and water can flow to the interior of the flexible tube 50.

In some embodiments, the flooding of the float basket 70 can cause the float basket 70 to almost immediately sink to the bottom of the tank 22, so that water can also flow to the drainage port 78 via the top opening of the annular wall 80. In such an embodiment, for example, the majority of water drained from the tank 22 may flow to the drainage port 78 via the top opening of the annular wall 80, at least until the water in the tank 22 has been drained sufficiently so that the annular wall 80 extends above the water line. In these and other embodiments, water may also flow into the draining port 78 via the drainage openings 82 (see, e.g., FIG. 8), particularly once the water level in the tank 22 is below the top opening of the annular wall 80.

In different embodiments, different mechanisms can be employed to cause the float basket 70 to be flooded. In the embodiment illustrated, for example, the internal lever 114 is secured to a chain 118, which in turn is attached to a cable 120. The cable 120 extends from the chain 118, through one of the anchor points 34 of the anchor plate 32, to be attached to the attachment tab 86 on the shallower end of the float basket 70. In this way, for example, as illustrated in FIG. 9B, when the handle 116 is pivoted downward, the lever 114, the chain 118, and the cable 120 cooperate to pull the shallower end of the float basket 70 underwater (e.g., to move the top of the peripheral wall 72 underwater, at the shorter-height end of the peripheral wall 72). Accordingly, water from the tank 22 floods into the interior reservoir 74, causing the float basket 70 to sink, such that water can flow into the toilet bowl via the top opening of the annular wall 80, the openings 82, 102 (see, e.g., FIG. 8), the tube 50, the seal assembly 38, and so on.

Generally, for all but the relatively low water levels in the tank 22, at least the lower-height end of the peripheral wall 72 may remain submerged, so that water can continue to flow from the tank 22, via the flush mechanism 20, into the toilet bowl. Correspondingly, for some duration of a flush cycle, the water level may fall below the top of the annular wall 80, but still remain above the lower-height end of the peripheral wall 72—i.e., may temporarily exhibit "intermediate" water levels. At these intermediate water levels, for example, the flow control provided by the collar 100 (see, e.g., FIG. 8) can be particularly useful. For example, if the water from the tank 22 is able to flow through the flush mechanism 20 too quickly, the interior reservoir 74 of the float basket 70 may drain, and the flushing may cease, before sufficient water has been drained from the tank. Conversely, if the water from the tank 22 is not able to flow through the flush mechanism 20 quickly enough, the simultaneous refilling of the tank 22 via the fill valve 112 may result in undesired swamping of the float basket 70, with corresponding continuous and un-checked flushing. In this regard, for example, a user can usefully manipulate the collar 100 to adjust the flow rate for the flush mechanism 20, to match the characteristics of the user's particular toilet and water system.

Eventually, as illustrated in FIG. 9C, the water level of the tank 22 may be sufficiently reduced so as to fall fully below the top of the peripheral wall 72 of the float basket 70. At this point, any remaining water in the interior reservoir 74 can drain through the tube 50 (now substantially compressed), and the float basket 70 can be floated on the now-rising water in the tank 22 to return to the "ready" state illustrated in FIG. 9A.

In the configuration illustrated in FIG. 9C, it can be readily seen that the inclined configuration of the top of the peripheral wall 72 can allow for substantially more water to be drained from the tank 22 during a flushing operation than if the peripheral wall 72 were not inclined. For example, if the peripheral wall 72 instead extended without an incline, as illustrated by line 72*a*, draining of the water from the tank via the flush mechanism 20 would cease with a substantially higher remaining amount of water, as illustrated by water line 122. This, in turn, could result in less satisfactory flushing performance for some systems.

In some embodiments, features not expressly illustrated in FIGS. 9A-9C can be provided. For example, in some embodiments, a bowl-fill conduit can be aligned to dispense water directly into the drainage port 78 of the float basket 70, in order to supplement the water flow through the interior reservoir 74 during flushing, and to provide water to refill the toilet bowl once flushing has completed (e.g., once the float basket 70 reaches the configuration illustrated in FIG. 9C).

Figure 10:
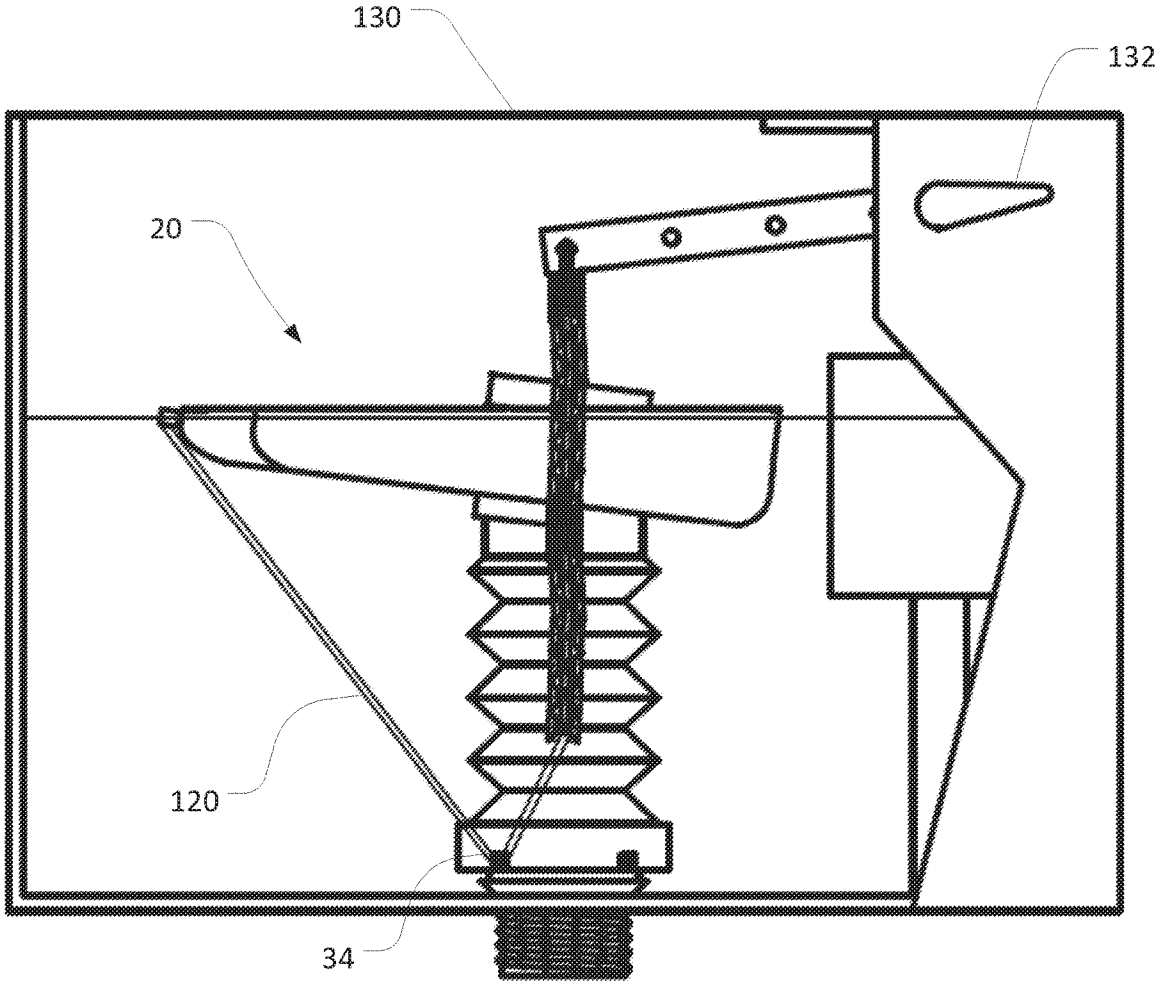
FIG. 10 is a side elevation view of the flush mechanism of FIGS. 9A through 9C installed in a different toilet tank Like reference numerals in the drawings indicate like components, parts, or operations.

In the configuration illustrated in FIGS. 9A-9C, the toilet tank 22 is configured with a left-hand flush mechanism. In other configurations, a right-hand flush mechanism may be provided. Embodiments of the invention can be readily adapted for either configuration or others (e.g., top-located push-button flush configurations). As one example, FIG. 10 illustrates a toilet tank 130 with a right-hand flush handle 132. Usefully, the flush mechanism 20 can be installed in the tank 130 in a similar fashion as illustrated for the tank 22 (see, e.g., FIG. 9A), with the eccentric float basket 70 having been rotated to extend farther to the left than to the right (from the perspective of FIG. 10), and with the cable 120 extending through the left-hand anchor point 34. In other embodiments, other configurations are possible.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A flush mechanism for a toilet with a tank that includes a flush port, the flush mechanism comprising:

a float basket with at least one peripheral wall that at least partly defines an interior reservoir of the float basket, and with a drainage port configured to drain the interior reservoir and an annular wall providing a rim around the drainage port, the float basket being configured to float on water within the tank;

a flexible conduit secured to the float basket to provide a liquid flow path between the drainage port and the flush port, such that water flooding from the tank into the interior reservoir and through the drainage port flows along the liquid flow path to exit the tank; and a top profile of the at least one peripheral wall being inclined to exhibit a varying height relative to the annular wall, with a lowest extent of the top profile below a top edge of the annular wall.

2. The flush mechanism of claim 1, wherein the top edge of the annular wall is not higher than a highest extent of the top profile of the at least one peripheral wall.

3. The flush mechanism of claim 1, wherein the top profile of the at least one peripheral wall extends linearly, from a side perspective, between a deeper end of the interior reservoir and a shallower end of the interior reservoir.

4. The flush mechanism of claim 1, wherein the drainage port is disposed eccentrically within the float basket.

5. The flush mechanism of claim 1, further comprising:

a collar with one or more collar openings;

wherein the rim surrounds the drainage port of the float basket and includes one or more rim openings, the one or more rim openings being configured to drain water from the interior reservoir into the drainage port; and wherein the collar is configured to rotate relative to the rim to control alignment of the one or more collar openings with the one or more rim openings to control a flow rate of water through the drainage port.

6. The flush mechanism of claim 1, with the toilet including a flush handle, the flush mechanism further comprising:

an anchor component with a plurality of anchor points;

a cable connected to the flush handle and to the float basket;

wherein the cable is configured to be received in a first of the anchor points to cause the float basket to be flooded when the flush handle is located and activated on a first side of the tank; and wherein the cable is configured to be received in a second of the anchor points to cause the float basket to be flooded when the flush handle is located and activated on a second side of the tank.

7. The flush mechanism of claim 6, wherein the anchor component includes an anchor plate that is rotatable around the liquid flow path.

8. The flush mechanism of claim 6, wherein the incline of the at least one peripheral wall defines a shorter-height end of the float basket; and wherein the cable is connected to the float basket at the shorter-height end of the float basket.

9. A flush mechanism for a toilet with a tank that includes a flush port, the flush mechanism comprising:

a float basket with at least one peripheral wall that at least partly defines an interior reservoir of the float basket, and with a drainage port configured to drain the interior reservoir and a rim formed around the drainage port, the float basket being configured to float on water within the tank;

a flexible conduit secured to the float basket to provide a liquid flow path between the drainage port and the flush port, such that water flooding from the tank into the interior reservoir flows along the liquid flow path to exit the tank;

the drainage port being disposed eccentrically within the float basket;

the at least one peripheral wall including a first side wall with a first inclined top profile and a second side wall, opposite the first side wall, with a second inclined top profile, each of the first and second inclined top profiles exhibiting, respectively, a varying height relative to the rim; and a top edge of the rim being above a lowest extend of the first and second inclined top profiles.

10. The flush mechanism of claim 9, wherein-the first and second inclined top profiles of the first and second side walls the top edge of the rim is at or below a highest extent of the first and second inclined top profiles.

11. The flush mechanism of claim 9, further comprising:

a seal assembly configured to route water from the flexible conduit through the flush port;

wherein the seal assembly includes an extension that extends through the flush port, and a conduit seat to secure the flexible conduit; and wherein the conduit seat is eccentrically disposed relative to the extension.

12. The flush mechanism of claim 9, with the toilet including a flush handle, the flush mechanism further comprising:

a cable connected to the flush handle and to the float basket, the cable being configured to tip the float basket to flood the interior reservoir when the flush handle is activated;

wherein the first and second inclined top profiles of the first and second side walls define a shorter-height end of the float basket; and wherein the cable is connected to the float basket at the shorter-height end of the float basket.

13. The flush mechanism of claim 12, further comprising:

an anchor component with at least two eyelets;

wherein the cable is configured to be received in a first of the eyelets to cause the float basket to be flooded when the flush handle is located and activated on a first side of the tank; and wherein the cable is configured to be received in a second of the eyelets to cause the float basket to be flooded when the flush handle is located and activated on a second side of the tank.

14. The flush mechanism of claim 9, wherein the rim includes one or more rim openings, the one or more rim openings being configured to drain water from the interior reservoir into the drainage port.

15. The flush mechanism of claim 14, further comprising:

a collar with one or more collar openings; and wherein the collar is configured to rotate relative to the rim to control alignment of the one or more collar openings with the one or more rim openings to control a flow rate of water through the drainage port.

16. A flush mechanism for a toilet with a tank that includes a flush port, the flush mechanism comprising:

a float basket with at least one peripheral wall, a drainage port configured to drain the float basket, and a rim that surrounds the drainage port and includes one or more rim openings, the float basket being configured to float on water within the tank;

a flexible conduit secured to the float basket to provide a liquid flow path between the drainage port and the flush port, such that water flooding from the tank into the float basket flows along the liquid flow path to exit the tank;

a collar with one or more collar openings;

the collar being configured to be secured around the rim, and to rotate relative to the rim, to control alignment of the one or more collar openings with the one or more rim openings to control a flow rate of water through the drainage port; and wherein a top profile of the at least one peripheral wall is inclined relative to the rim to define a shorter-height end of the float basket that is below a top edge of the rim.

17. The flush mechanism of claim 16, wherein the rim includes a plurality of the rim openings; and wherein the collar includes a plurality of the collar openings.

18. The flush mechanism of claim 16, wherein the incline of the at least one peripheral wall defines a taller-height end of the float basket that is at or above the top edge of the rim.

19. The flush mechanism of claim 16, wherein the drainage port being disposed eccentrically within the float basket.

20. The flush mechanism of claim 19, with the toilet including a flush handle, the flush mechanism further comprising:

a cable connected to the flush handle and to the float basket, the cable being configured to tip the float basket to flood the float basket when the flush handle is activated;

wherein the cable is connected to the float basket at the shorter-height end of the float basket; and wherein the drainage port is disposed farther from the shorter-height end of the float basket than from an opposite end of the float basket.

* * * * *